US007631862B2

(12) United States Patent
Yorimoto et al.

(10) Patent No.: US 7,631,862 B2
(45) Date of Patent: Dec. 15, 2009

(54) DEVICE FOR FEEDING A RECORDING MEDIUM AT A CONTROLLED DISTANCE AND IMAGE FORMING APPARATUS HAVING SUCH DEVICE

(75) Inventors: Mamoru Yorimoto, Tokyo (JP); Mitsuru Yamada, Tokyo (JP); Masashi Kimijima, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 229 days.

(21) Appl. No.: 11/260,208

(22) Filed: Oct. 28, 2005

(65) Prior Publication Data

US 2006/0180988 A1 Aug. 17, 2006

(30) Foreign Application Priority Data

Oct. 28, 2004 (JP) ..... 2004-313382

(51) Int. Cl.
*B65H 3/06* (2006.01)

(52) U.S. Cl. ..... 271/118; 271/119

(58) Field of Classification Search ..... 271/110, 271/118, 119, 121, 124
See application file for complete search history.

(56) References Cited

U.S. PATENT DOCUMENTS 4,508,332 A * 4/1985 Nishio ..... 271/118
4,573,674 A * 3/1986 Nogi et al. ..... 271/118
4,779,861 A * 10/1988 Ozawa et al. ..... 271/119
5,746,426 A * 5/1998 Nakabayashi et al. ..... 271/119
5,954,328 A * 9/1999 Hatanaka ..... 271/119
6,082,726 A * 7/2000 Inoue et al. ..... 271/4.08
6,305,682 B1 * 10/2001 Saito et al. ..... 271/10.11
6,900,611 B2 * 5/2005 Yoshino et al. ..... 318/696
2004/0188922 A1 9/2004 Takahashi et al.
2004/0247349 A1 12/2004 Takahashi et al.
2004/0257430 A1 12/2004 Takahashi et al.
2005/0140081 A1 * 6/2005 Sugimura et al. ..... 271/118

FOREIGN PATENT DOCUMENTS

JP 01069426 A * 3/1989
JP 02132024 A * 5/1990
JP 05-201557 8/1993
JP 05-301644 11/1993
JP 2002-087608 3/2002
JP 2002087608 A * 3/2002

(Continued)

*Primary Examiner*—Patrick H Mackey
*Assistant Examiner*—Michael C McCullough
(74) *Attorney, Agent, or Firm*—Oblon, Spivak, McClelland, Maier & Neustadt, L.L.P.

(57) ABSTRACT

A sheet feeding device comprises a sheet feeding roller, having a first circumferential section and a second circumferential section, configured to rotate in a direction from the first circumferential section to the second circumferential section; and a pressure plate provided apart from the sheet feeding roller and configured to mount thereon a recording sheet stack having recording sheets ranging from a maximum number to a minimum number. The first circumferential section includes a first contact point for contacting, when the sheet feeding roller is rotated, a leading top edge of the recording sheet stack having the maximum number of recording sheets; and a second contact point for contacting, when the sheet feeding roller is rotated, a leading top edge of the recording sheet stack having the minimum number of recording sheets.

23 Claims, 8 Drawing Sheets

FOREIGN PATENT DOCUMENTS

| | | |
|---|---|---|
| JP | 2002-265095 | 9/2002 |
| JP | 2002-321839 | 11/2002 |
| JP | 2002-362760 | 12/2002 |
| JP | 2003-212368 | 7/2003 |
| JP | 2004-107040 | 4/2004 |
| JP | 3548551 | 4/2004 |

* cited by examiner

BACKGROUND ART

DEVICE FOR FEEDING A RECORDING MEDIUM AT A CONTROLLED DISTANCE AND IMAGE FORMING APPARATUS HAVING SUCH DEVICE

BACKGROUND OF THE INVENTION

1. Field of the Invention

The following disclosure relates generally to a device for feeding a recording medium at a controlled distance and an apparatus for forming an image on the recording medium fed by the device.

2. Background of the Invention

In a background image forming apparatus, a sheet feeding roller is provided for feeding a recording sheet one by one from a stack of recording sheets, which is mounted on a pressure plate, as illustrated in FIGS. 3A and 3B, for example. However, the distance between two consecutive recording sheets may fluctuate depending on the height of the stack, i.e., the number of recording sheets. Thus, the sheet feeding operation may become unstable, causing the problem of non-feeding, deforming the sheet, double feeding, etc.

SUMMARY

According to an exemplary embodiment of the present invention, a sheet feeding device comprises a sheet feeding roller, having a first circumferential section and a second circumferential section, configured to rotate in a direction from the first circumferential section to the second circumferential section, and a pressure plate provided apart from the sheet feeding roller and configured to mount thereon a recording sheet stack having recording sheets ranging from a maximum number to a minimum number. The first circumferential section comprises a first contact point for contacting, when the sheet feeding roller is rotated, a leading top edge of the recording sheet stack having the maximum number of recording sheets; and a second contact point for contacting, when the sheet feeding roller is rotated, a leading top edge of the recording sheet stack having the minimum number of recording sheets.

Preferably, the first circumferential section is made of a material having a low friction coefficient with respect to the recording sheet. The second circumferential section is made of a material having a high friction coefficient with respect to the recording sheet.

According to another exemplary embodiment of the present invention, the above-described sheet feeding device may further include a sheet detector configured to generate a detection result indicating whether a trailing top edge of the recording sheet stack is detected and to cause the sheet feeding roller to rotate based on the detection result. The sheet detector is preferably provided near the pressure plate at a portion determined by a minimum sheet size of the recording sheet.

In addition to those described above, the present invention may be implemented in various other ways as appreciated by those skilled in the art within the scope and spirit of the following disclosure and the appended claims. Further, the above-described sheet feeding device is capable of feeding any kind of recording medium, such as a paper sheet or a transparent sheet, for example.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
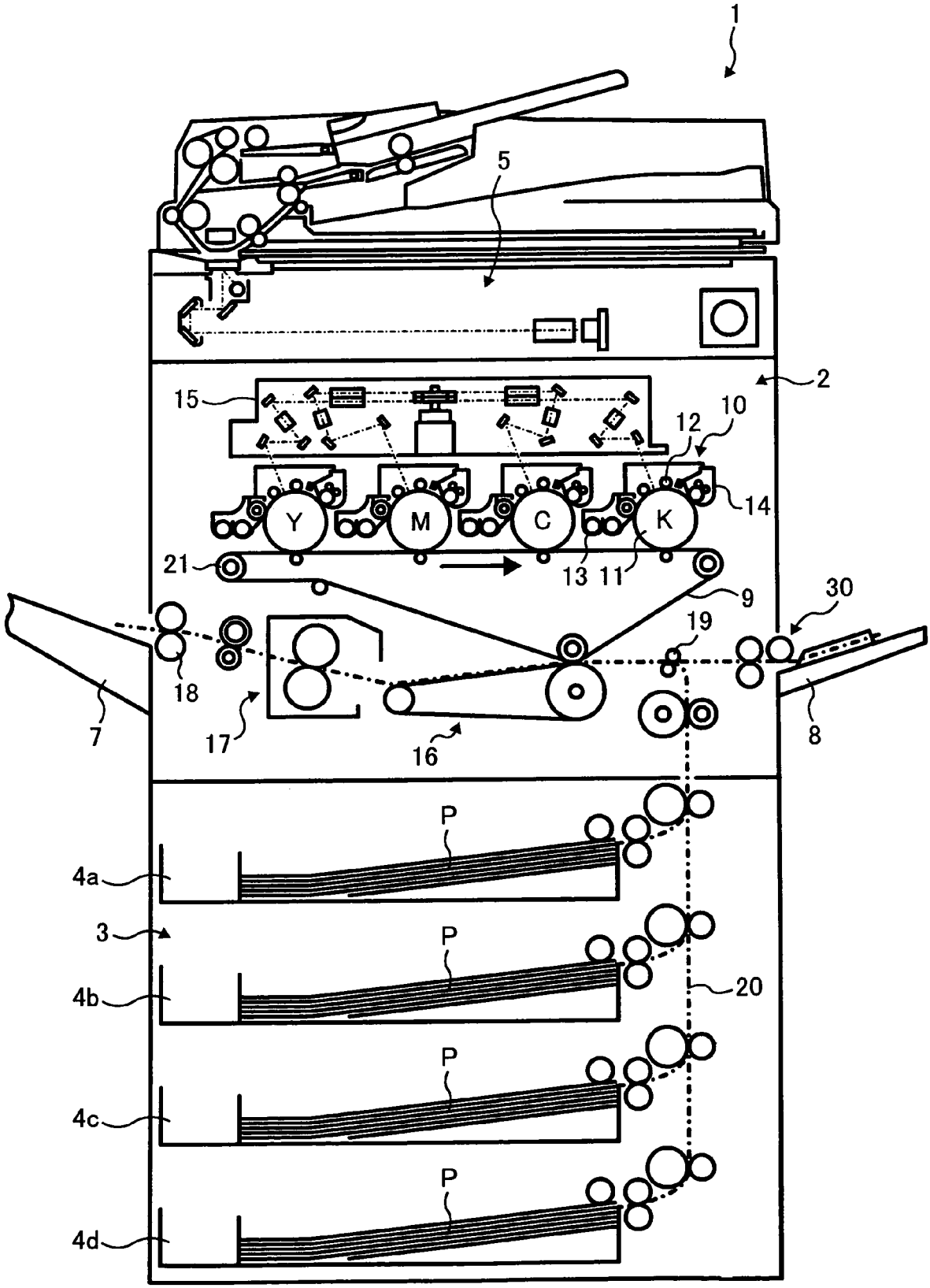
FIG. 1 is a cross-sectional view illustrating the structure of an image forming apparatus according to an exemplary embodiment of the present invention.

In describing the exemplary embodiments illustrated in the drawings, specific terminology is employed for clarity. However, the disclosure of this patent specification is not intended to be limited to the specific terminology selected and it is to be understood that each specific element includes all equivalents that operate in a similar manner. Referring now to the drawings, wherein like reference numerals designate identical or corresponding parts throughout the several views, FIG. 1 illustrates an image forming apparatus according to an exemplary embodiment of the present invention.

The image forming apparatus 1 is capable of forming an image on a recording sheet using an electrophotographic method. As shown in FIG. 1, the image forming apparatus 1 mainly includes a scanner section 5, an image forming section 2, and a sheet feeding section 3.

The scanner section 5 reads an original image into image data. As shown in FIG. 1, an automatic document feeder may be optionally provided above the scanner section 5 to feed the original image. Alternatively, the original image may be placed on an exposure glass provided on the scanner section 5.

Based on the image data obtained by the scanner section 5, the image forming section 2 forms a full color image on the recording sheet using an optical writing device 15, a plurality of image forming devices 10Y, 10M, 10C, and 10K (collectively referred to as the "image forming device 10"), an intermediate transfer device 9, a transfer device 16, a fixing device 17, a transfer device cleaner 21, etc.

The optical writing device 15 includes a light source for irradiating a light toward the image forming device 10. The image forming device 10Y forms a yellow toner image. The image forming device 10M forms a magenta toner image. The image forming device 10C forms a cyan toner image. The image forming device 10K forms a black toner image. As shown in FIG. 1, the image forming device 10 includes at least a photoconductor 11, a charger 12, a developer 13, and a cleaner 14. The intermediate transfer device 9 may be implemented by an endless belt wound around a plurality of rollers. The transfer device 16, which is optionally provided, may be implemented by an endless belt wound around a plurality of rollers. The fixing device 17 includes a pair of rollers such as a fixing roller and a pressure roller. The transfer device cleaner 21 cleans the intermediate transfer device 9, i.e., the surface of the endless belt.

The sheet feeding section 3 stores or transfers the recording sheet in the image forming apparatus 1. The sheet feeding section 3 mainly includes a plurality of sheet feeding cassettes 4*a*, 4*b*, 4*c*, and 4*d*, a discharge tray 7, a manual feed tray 8, a discharging roller pair 18, a registration roller pair 19, a plurality of sheet feeding devices including a sheet feeding device 30, etc.

Each of the sheet feeding cassettes 4*a*, 4*b*, 4*c*, and 4*d* stores one or more recording sheets P therein. The number of sheet feeding cassettes is not limited to four as shown in FIG. 1. Further, any one of the sheet feeding cassettes 4*a*, 4*b*, 4*c*, and 4*d* may be drawn out from the image forming apparatus 1. The discharge tray 7 is provided downstream in a sheet transfer passage 20, such as at a position near the discharging roller pair 18. The manual feed tray 8 is provided upstream in the sheet transfer passage 20, such as at a position near the sheet feeding device 30.

In an example image forming operation, the scanner section 5 scans an original image into image data. According to the image data, the optical writing device 15 exposes a light onto the surface of the photoconductor 11 to form an electrostatic latent image thereon. The photoconductor 11 is rotated such that its surface is charged by the charger 12. The developer 13 develops the electrostatic latent image into a toner image. The cleaner 14 removes residual toner remained on the surface of the photoconductor 11 to prepare for another image forming operation.

The toner image formed by the developer 13 is transferred to the surface of the intermediate transfer device 9. For example, a yellow toner image formed by the image forming device 10Y is transferred onto the intermediate transfer device 9. A magenta toner image formed by the image forming device 10M is transferred onto the intermediate transfer device 9. A cyan toner image formed by the image forming device 10C is transferred onto the intermediate transfer device 9. A black toner image formed by the image forming device 10K is transferred onto the intermediate transfer device 9. These toner images of four colors are superimposed one above another to form a full color toner image. The transfer device 16 transfers the toner image onto the recording sheet P, which is carried by the registration roller pair 19. The fixing device 17 fixes the toner image onto the recording sheet P. The recording sheet P carrying the toner image is then output through the discharge roller pair 18 to the discharge tray 7.

The registration roller pair 19 receives the recording sheet P either from the manual feed tray 8 or from any one of the sheet feeding cassettes 4*a*, 4*b*, 4*c*, and 4*d*. In this example, the registration roller pair 19 feeds the recording sheet P with a timing in synchronization with the image forming operation of the image forming section 2.

As shown in FIG. 1, the sheet feeding section 3 includes the plurality of sheet feeding devices including the sheet feeding device 30, a sheet feeding device provided near the sheet feeding cassette 4*a*, a sheet feeding device provided near the sheet feeding cassette 4*b*, a sheet feeding device provided near the sheet feeding cassette 4*c*, and a sheet feeding device provided near the sheet feeding cassette 4*d*. In this example, at least one of the sheet feeding devices of the image forming apparatus 1 includes a sheet feeding roller 101 and a pressure plate 102 shown in FIGS. 2A and 2B.

Figure 2A:
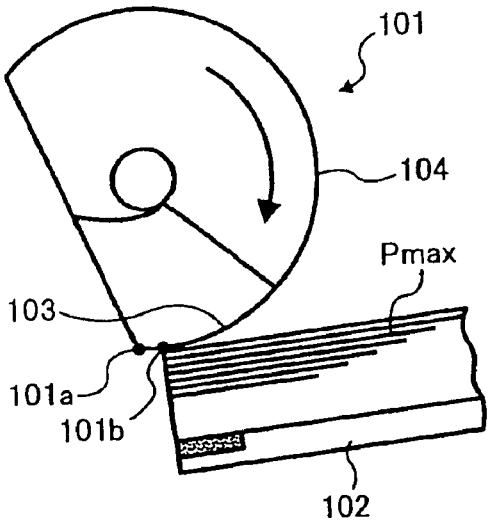
FIG. 2A is a schematic cross-sectional view illustrating the structure of a sheet feeding device provided with a maximum number of recording sheets, according to an exemplary embodiment of the present invention.
Figure 2B:
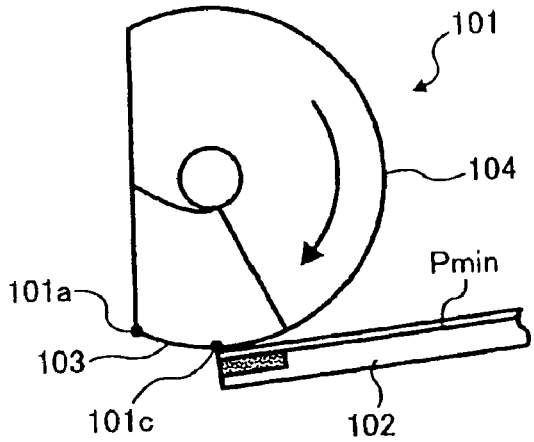
FIG. 2B is a schematic cross-sectional view illustrating the structure of the sheet feeding device shown in FIG. 2A provided with a minimum number of recording sheets.

Referring to FIGS. 2A and 2B, the sheet feeding roller 101 includes a first circumferential section 103 and a second circumferential section 104. The first circumferential section 103 has relatively a low friction coefficient with respect to the recording sheet P. The second circumferential section 104 has relatively a high friction coefficient with respect to the recording sheet P. The pressure plate 102 is provided apart from the sheet feeding roller 101 at its initial position. As illustrated in FIGS. 2A and 2B, the pressure plate 102 mounts thereon a recording sheet stack having recording sheets P ranging from a maximum number to a minimum number.

When activated, the sheet feeding roller 101 rotates in the direction from the first circumferential section 103 to the second circumferential section 104. In synchronization with the rotation of the sheet feeding roller 101, the pressure plate 102 moves toward the sheet feeding roller 101 until a leading edge of a recording sheet P placed at the top of the stack mounted on the pressure plate 102 contacts the sheet feeding roller 101.

For example, as illustrated in FIG. 2A, when a stack Pmax having the maximum number of recording sheets P is mounted on the pressure plate 102, the pressure plate 102 moves toward the sheet feeding roller 101 until the leading edge of the top recording sheet (the "leading top edge") of the stack Pmax contacts the first circumferential section 103 at a first contact point 101*b*. As the sheet feeding roller 101 continues to rotate, the leading top edge of the stack Pmax stays relatively at the same position. When the leading top edge of the stack Pmax contacts the point where the second circumferential section 104 starts, the top recording sheet P is transferred with the rotation of the sheet feeding roller 101.

In another example, as illustrated in FIG. 2B, when a stack Pmin having the minimum number of recording sheets P is mounted on the pressure plate 102, the pressure plate 102 moves toward the sheet feeding roller 101 until the leading top edge of the stack Pmin contacts the first circumferential section 103 at a second contact point 10*c*. As the sheet feeding roller 101 continues to rotate, the leading top edge of the stack Pmin stays relatively at the same position. When the leading top edge of the stack Pmin contacts the point where the second circumferential section 104 starts, the top recording sheet P is transferred with the rotation of the sheet feeding roller 101.

As shown in FIGS. 2A and 2B, the first circumferential section 103 has a circumferential length sufficient enough to cover at least the first contact point 101*b* and the second contact point 101*c*. With this structure, the distance between two consecutive recording sheets P may be kept relatively constant, as compared with the exemplary case of the background sheet feeding device shown in FIG. 3A or 3B.

Figure 3A:
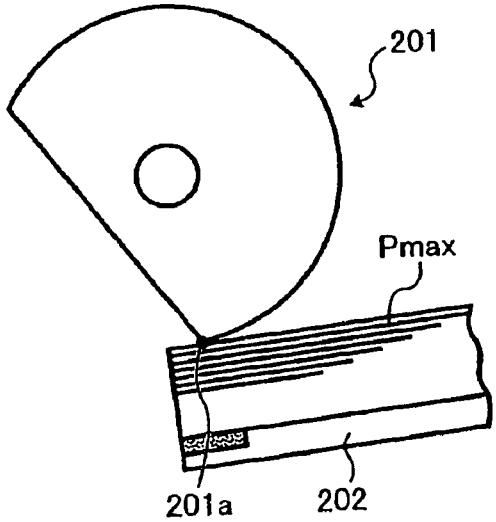
FIG. 3A is a schematic cross-sectional view illustrating the structure of a background sheet feeding device provided with a maximum number of recording sheets.
Figure 3B:
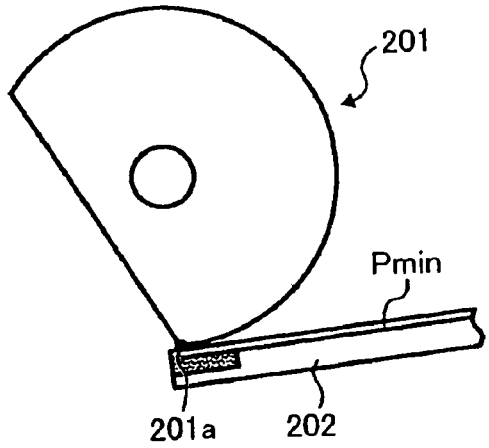
BACKGROUND ART FIG. 3B
FIG. 3B is a schematic cross-sectional view illustrating the structure of the background sheet feeding device shown in FIG. 3A provided with a minimum number of recording sheets.

Further, referring to FIG. 2A, the leading top edge of the stack Pmax is prevented from contacting a leading edge point 101*a* of the sheet feeding roller 101, as compared to the exemplary case of the background sheet feeding device shown in FIG. 3A. As a result, the pressure generated between the sheet feeding roller 101 and the recording sheet P may be kept relatively constant, allowing the sheet feeding operation to be more stable. The constant pressure may further suppress a damage caused on the recording sheet P.

As described above, the sheet feeding roller 101 and the pressure plate 102 may be incorporated in any one of the sheet feeding devices of the image forming apparatus 1. For descriptive purposes, the following examples assume that the sheet feeding device 30 has the structure or function described referring to FIGS. 2A and 2B.

Figure 4:
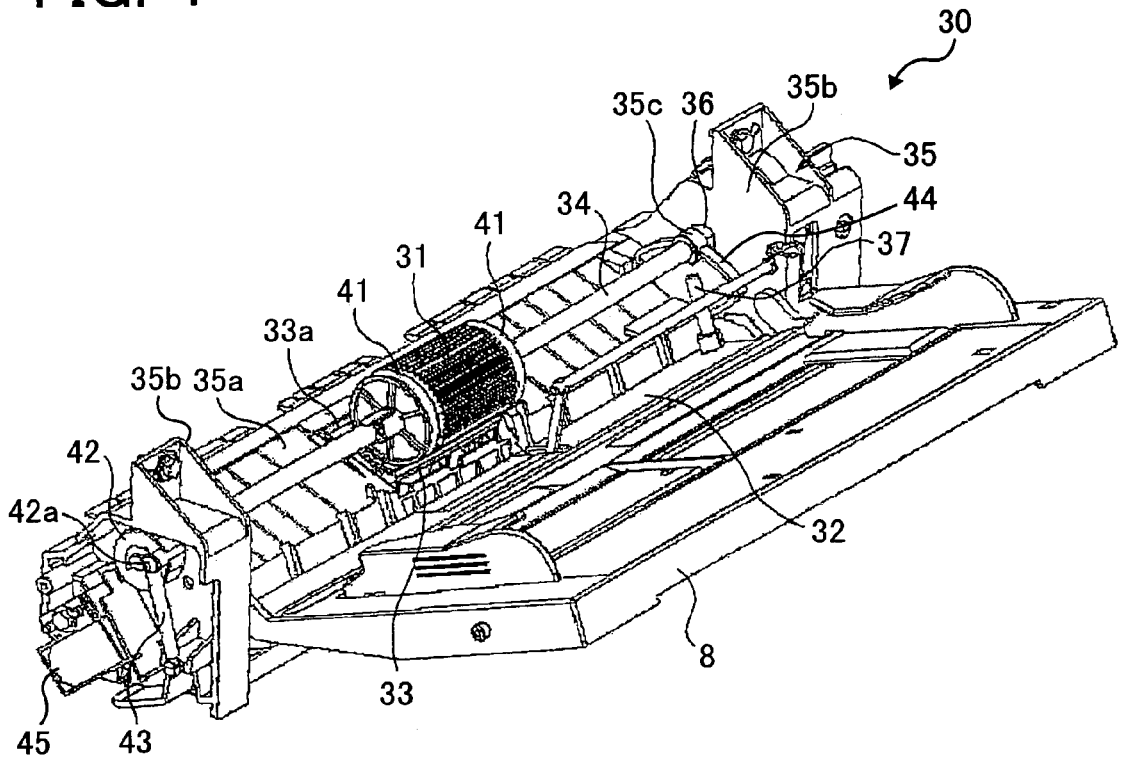
FIG. 4 is a perspective view illustrating the structure of a sheet feeding device with a manual feed tray according to an exemplary embodiment of the present invention.
Figure 5:
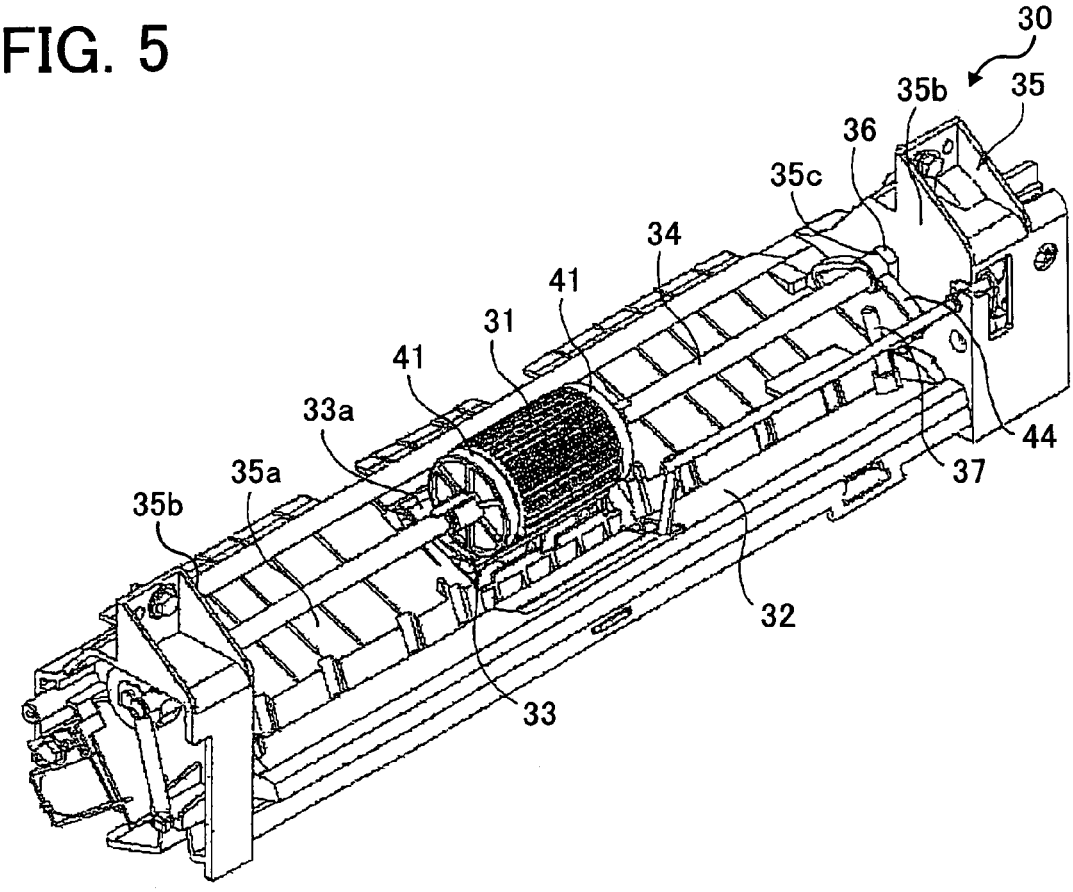
FIG. 5 is a perspective view illustrating the structure of the sheet feeding device of FIG. 4 without the manual feed tray.

As shown in FIGS. 4 and 5, the sheet feeding device 30 mainly includes a pickup roller 31, a base plate 32, and a friction pad 33, which are supported by a support body 35.

Figure 9A:
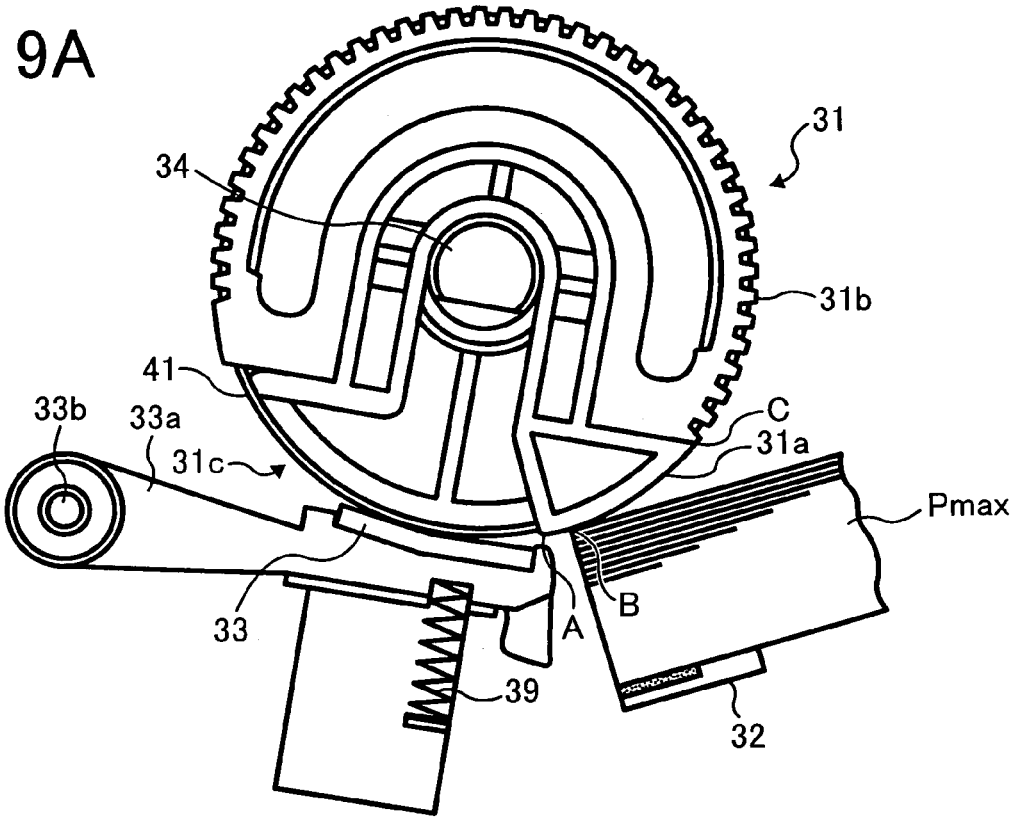
FIG. 9A is a schematic cross-sectional view illustrating a portion of the sheet feeding device of FIG. 4 having the pickup roller, the base plate, and the friction pad, when a maximum number of recording sheets is provided.
Figure 9B:
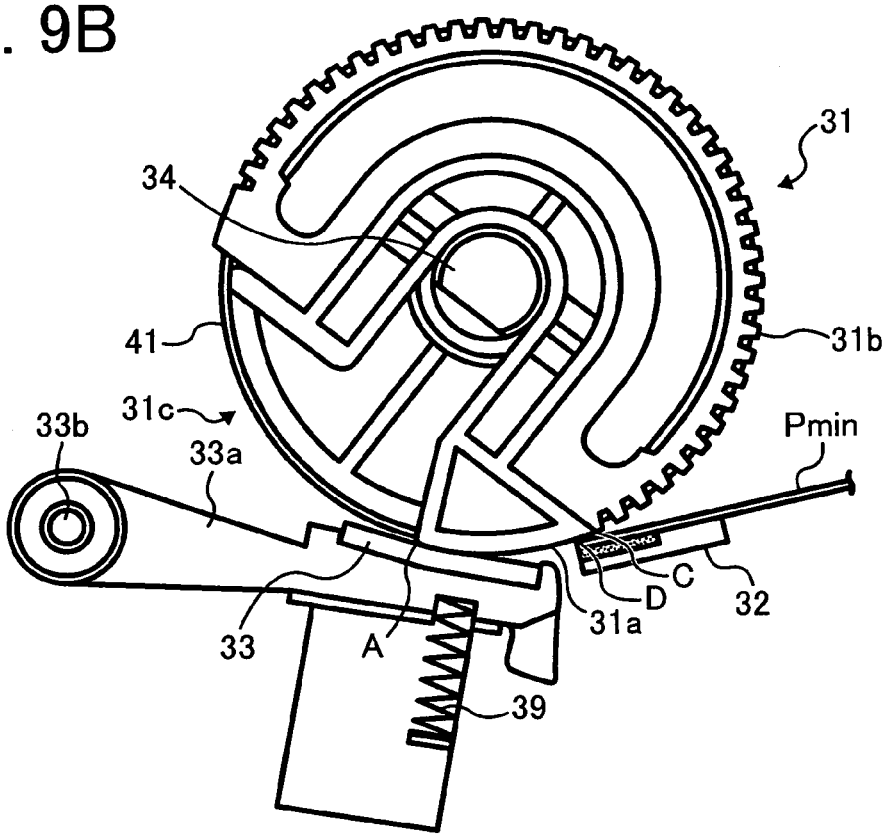
FIG. 9B is a schematic cross-sectional view illustrating a portion of the sheet feeding device of FIG. 4 having the pickup roller, the base plate, and the friction pad, when a minimum number of recording sheets is provided.

The pickup roller 31, which functions as the sheet feeding roller 101 of FIGS. 2A and 2B, rotates in the clockwise direction to feed a recording sheet P mounted on the manual feed tray 8. The pickup roller 31 is placed in a portion facing a central portion of the manual feed tray 8. This allows the pickup roller 31 to closely contact a central portion of the recording sheet P, which may be placed in any orientation on the manual feed tray 8. The pickup roller 31 is integrally formed with a roller shaft 34, which is rotatably fixed onto two second side surfaces 35*b* of the support body 35. Further, in this example, the pickup roller 31 has a cross section of semilunar shape as shown in FIG. 9A or 9B. This may suppress the amount of contact between the pickup roller 31 and the friction pad 33 during a sheet feeding operation. Referring back to FIGS. 4 and 5, the pickup roller 31 is further provided with a pair of guide rollers 41. The guide rollers 41 each have diameters smaller than a diameter of the pickup roller 31.

As shown in FIGS. 4 and 5, one end of the roller shaft 34 is inserted into an opening 35*c* via a roller shaft receiver 36, which is provided on the corresponding one of the second side surfaces 35*b*. Although not shown, the other end of the roller shaft 34 is rotatably fixed to the other one of the second side surfaces 35*b* in a similar manner. The support body 35 further includes a first side surface 35*a*, which is inclined so as to face the pickup roller 33. The first side surface 35*a* guides the recording sheet P from the manual feed tray 8 toward the sheet transfer passage 20 of FIG. 1. In this example, the support body 35 may be made of resin.

The base plate 32, which is provided at a lower end of the manual feed tray 8, functions as the pressure plate 102 of FIGS. 2A and 2B for causing the recoding sheet P to closely contact the pickup roller 31. The base plate 32 may be made of resin.

Figure 6:
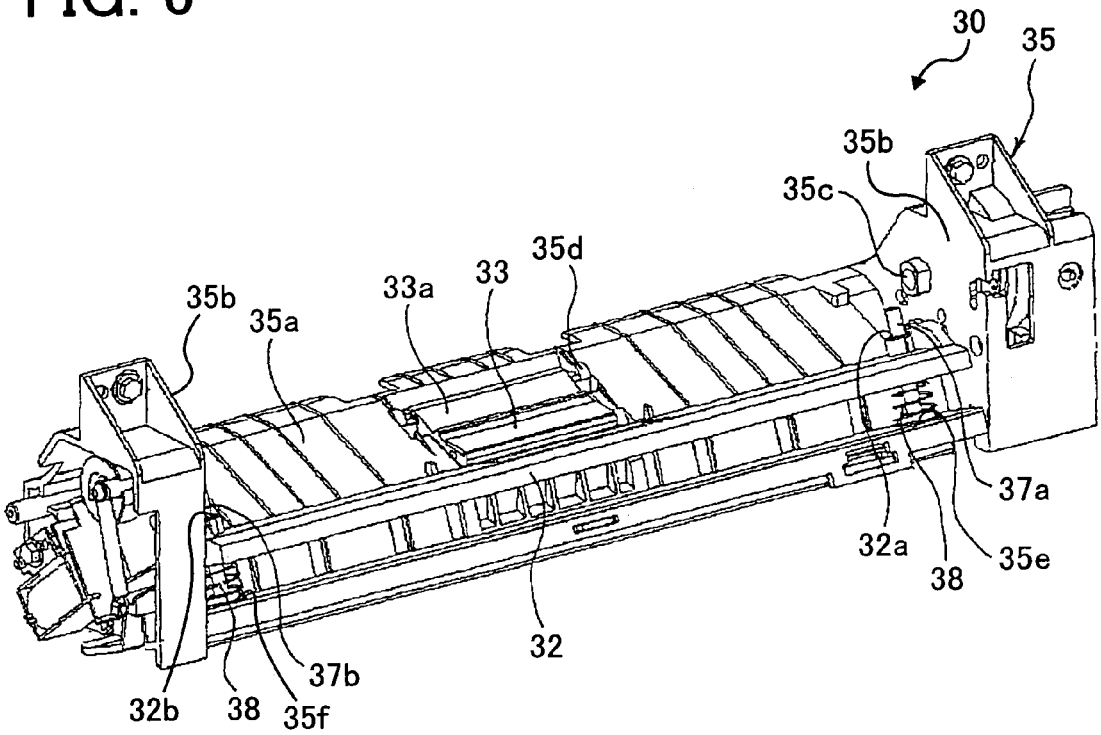
FIG. 6 is a perspective view illustrating the structure of the sheet feeding device of FIG. 4 without the pickup roller.

As shown in FIG. 6, the base plate 32 is fixed to the support body 35 via a first guide shaft 37*a* and a second guide shaft 37*b*. A first body opening 35*e* and a second body opening 35*f* are provided on a bottom side surface of the support body 35 at respective portions near the second side surfaces 35*b*. A first plate opening 32*a* is provided on the base plate 32 at a portion corresponding to the first body opening 35*e*. A second plate opening 32*b* is provided on the base plate 32 at a portion corresponding to the second body opening 35*f*. The first guide shaft 37*a* is pressed into the first body opening 35*e* through the first plate opening 32*a*. The second guide shaft 37*b* is pressed into the second body opening 35*f* through the second plate opening 32*b*. With this configuration, the base plate 32 moves towards or away from the pickup roller 31 along the first and second guide shafts 37*a* and 37*b*. To support this movement of the base plate 32, plate springs 38 may be respectively wound around the first and second guide shaft 37*a* and 37*b* as shown in FIG. 6.

Referring back to FIGS. 4 and 5, the friction pad 33 is provided on the support body 35 in a portion facing the pickup roller 31 to separate one recording sheet P from the stack of recording sheets P. The friction pad 33 may be formed by a flat plate made of a material having relatively a high friction coefficient with respect to the recording sheet P, such as rubber, rubber cork, urethane foam, thermoplastic elastomer, etc.

Figure 7:
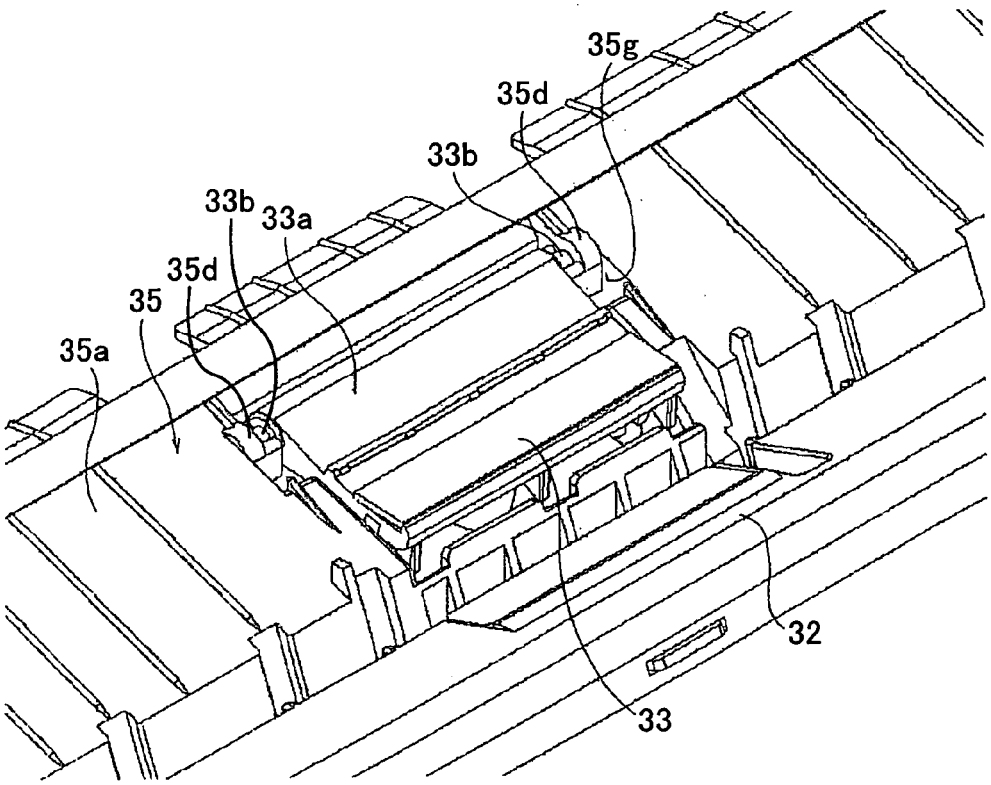
FIG. 7 is an enlarged perspective view illustrating a portion of the sheet feeding device of FIG. 4 including a friction pad.

As shown in FIG. 7, the first side surface 35*a* of the support body 35 has an opening 35*g* facing the pickup roller 31. The friction pad 33 is attached to a pad plate 33*a*, which is fit into the opening 35*g*, by an adhesive tape, for example. The pad plate 33*a* is fixed onto two side surfaces of the opening 35*g*, through a pad shaft 33*b* and a pair of pad shaft receivers 35*d*, in parallel to the roller shaft 34. One end of the pad shaft 33*b* is rotatably fixed to the corresponding one of the pad shaft receivers 35*d*. The friction pad 33 can be moved toward the pickup roller 31, or it can be moved away from the pickup roller 31. For example, a pressure spring 39 of FIG. 9A or 9B may be provided below the pad plate 33*a* to cause the friction pad 33 to move towards or away from the pickup roller 31.

As described above referring to FIGS. 4 to 7, the support body 35 determines the position of the pickup roller 31 through the openings 35*c*, the position of the base plate 32 through the guide shafts 37*a* and 37*b*, and the position of the friction pad 33 through the shaft receivers 35*d*. By increasing the positional accuracy of these components in the sheet feeding device 30, the recording sheet P may be transferred more smoothly without causing the sheet feeding problem, such as the problem of non-feeding, deforming the sheet, or double feeding.

Figure 8:
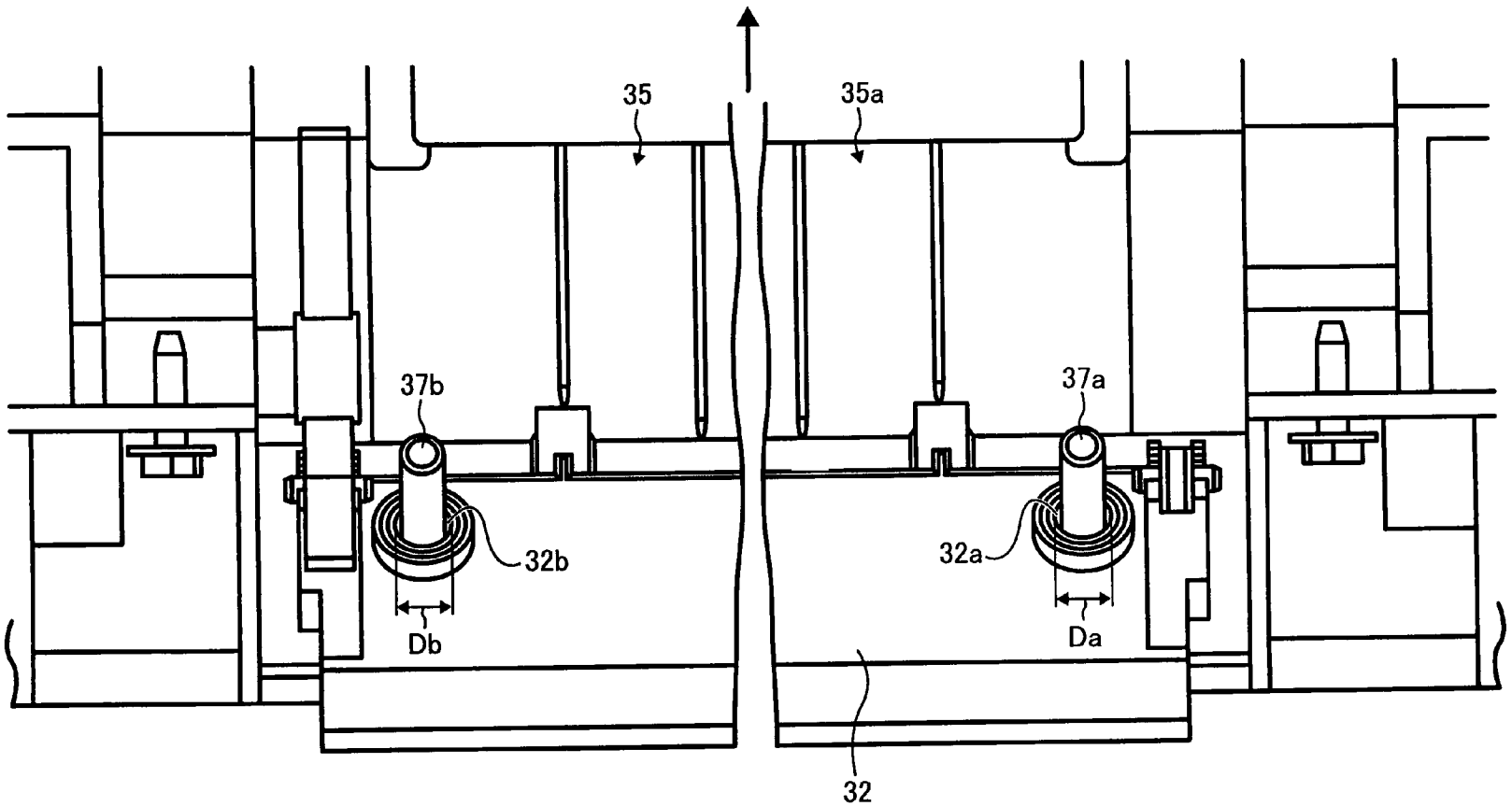
FIG. 8 is a schematic side view illustrating a portion of the sheet feeding device of FIG. 4 including a base plate.

Further, in this example, any one of the first and second plate openings 32*a* and 32*b* formed on the base plate 32 may not have a circular shape. Furthermore, the shapes of the first and second plate openings 32*a* and 32*b* may be different from each other. For example, as illustrated in FIG. 8, the length in the sheet transfer direction, which is indicated by an arrow, of the first plate opening 32*a* corresponds to the length of the first guide shaft 37*a* in the sheet transfer direction. Similarly, the length in the sheet transfer direction of the second plate opening 32*b* corresponds to the length of the second guide shaft 37*b* in the sheet transfer direction. In this example, the first and second plate openings 32*a* and 32*b* are the same in length in the sheet transfer direction, while they are different in length in the sheet width direction, i.e., the direction perpendicular to the sheet transfer direction. As shown in FIG. 8, the length Da of the first plate opening 32*a* in the sheet width direction is made smaller than the length Db of the second plate opening 32*b* in the sheet width direction.

By making the lengths of the first and second plate openings 32*a* and 32*b* different from each other, the recording sheet P may be transferred more smoothly. For example, the plate springs 38 may press the base plate 32 to cause the base plate 32 to bend. However, such pressure caused by the plate springs 38 may be released by the second plate opening 32*b* having the length Db. In this manner, the pressure between the base plate 32 and the pickup roller 31 may be kept relatively constant. Thus, the recording sheet P may be transferred more smoothly, without causing the sheet feeding problem. In this example, the distance Db is made larger than the distance Da, however, the distance Da may be made larger than the distance Db.

Referring now to FIGS. 9A and 9B, the structure of the pickup roller 31 is explained in greater detail.

The pickup roller 31 includes a first circumferential section 31*a* and a second circumferential section 31*b*. The first circumferential section 31*a* is made of a material having relatively a low friction coefficient with respect to the recording sheet P, such as resin, for example. The second circumferential section 31*b* is made of a material having a relatively high friction coefficient with respect to the recording sheet P, such as rubber, for example. The pickup roller 31 further includes a cut section 31*c* facing the friction pad 33.

Referring to FIGS. 9A and 9B, the circumferential length of the first circumferential section 31*a* is made about one fourth to one third of the circumferential length of the cut section 31*c*. More specifically, the circumferential length of the first circumferential section 31*a* is determined so as to include a first contact point B shown in FIG. 9A and a second contact point D shown in FIG. 9B. As shown in FIG. 9A, the first contact point B is the point at which the leading top edge of the stack Pmax contacts the first circumferential section 31*a*. As shown in FIG. 9B, the second contact point D is the point at which the leading top edge of the stack Pmin contacts the first circumferential section 31*a*. In this example, the stack Pmin includes one recording sheet P.

As shown in FIGS. 9A and 9B, the circumferential length of the first circumferential section 31*a*, i.e., the length between a leading edge point A and a trailing edge point C, may be made larger than the length between the first contact point B and the second contact point D. Alternatively, the circumferential length of the first circumferential section 31*a* may be made substantially equal to the length between the first contact point B and the second contact point D. However, it may be desirable to have the circumferential length larger than the length between the first contact point B and the second contact point D as the position of the first contact point B or the second contact point C may fluctuate due to the movement of the base plate 32. Further, by preventing the leading edge point A from contacting the recording sheet P, the pressure between the pickup roller 31 and the recording sheet P may be kept relatively constant.

In this example, the radius of the first circumferential section 31*a* with respect to the center of the pickup roller 31 is made substantially equal to the radius of the second circumferential section 31*b*. However, the first circumferential section 31*a* and the second circumferential section 31*b* may have radiuses different from each other as long as the transition from the first circumferential section 31*a* to the second circumferential section 31*b* can be made smoothly. Preferably, at least the radius of the first circumferential section 31*a* at the second contact point D and the radius of the first circumferential section 31*a* at the trailing edge point C may be made substantially equal.

Figure 10:
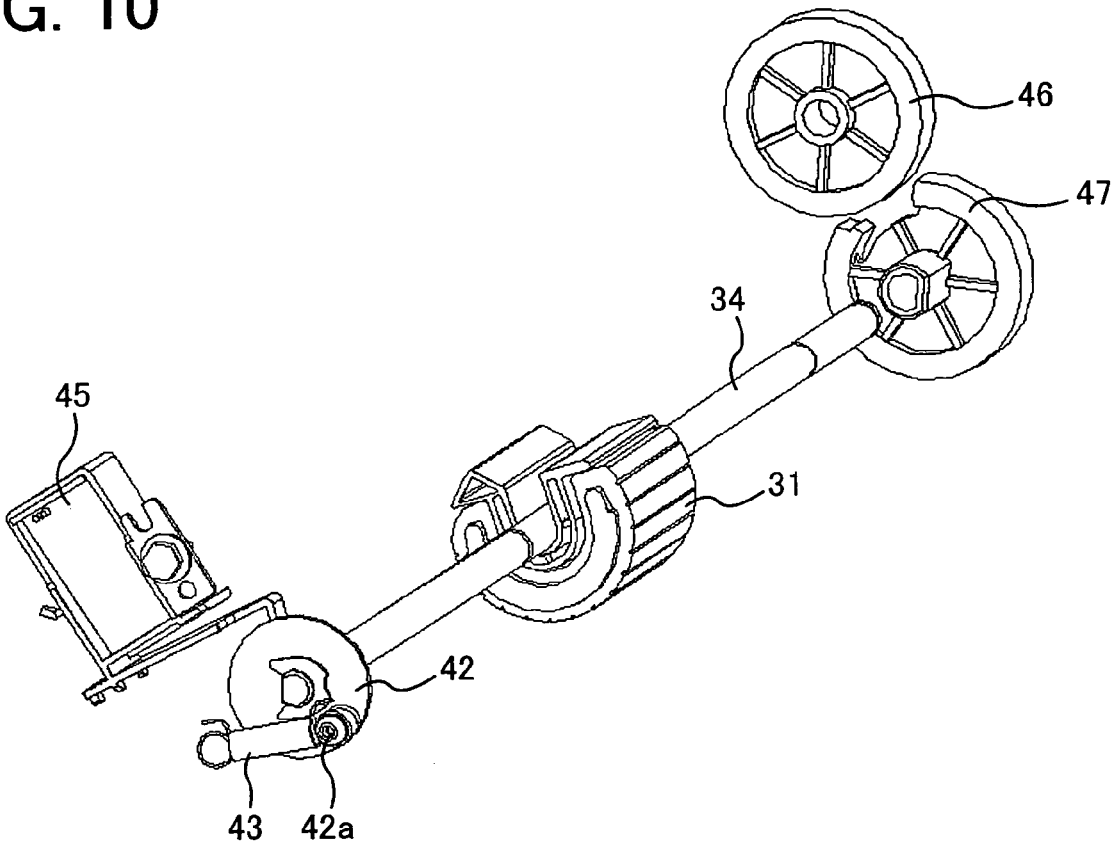
FIG. 10 is a perspective view illustrating a portion of the sheet feeding device of FIG. 4 having the pickup roller and a roller position controller.
Figure 11:
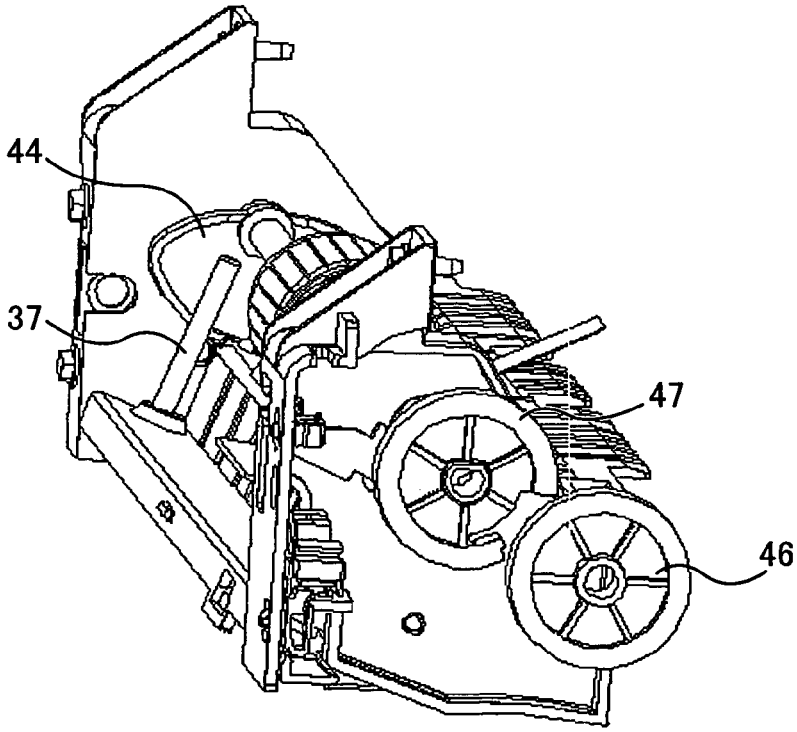
FIG. 11 is a perspective view illustrating a portion of the sheet feeding device of FIG. 4 having a drive gear and a feed gear.

Referring now to FIGS. 4, 10 and 11, operation of driving the pickup roller 31 is explained according to an exemplary embodiment of the present invention.

As shown in FIGS. 4 and 10, the sheet feeding device 30 additionally includes a roller position controller 42, a roller spring 43, and a solenoid 45 on one outer side surface of the support body 35, and a drive gear 46 and a feed gear 47 on the other outer side surface of the support body 35. One end of the roller shaft 34 is fixed to the roller position controller 42, while the other end of the roller shaft 34 is fixed to the feed gear 47. The solenoid 45 may comprise a direct current (DC) solenoid, which can control rotation of the pickup roller 31. The drive gear 46 continuously rotates in the counterclockwise direction. The feed gear 47 has a toothless portion facing the drive gear 46 in its initial position.

As shown in FIG. 10, at the initial position or when the solenoid 45 is turned off, a flapper of the solenoid 45 closely contacts the protrusion 42*a* to suppress the rotation of the roller shaft 34. As the toothless portion stays in the position facing the drive gear 46, the power of the drive gear 46 is not transmitted to the feed gear 47. When the solenoid 45 is turned on, for example, by receiving an actuation signal, the flapper of the solenoid 45 is moved away from the protrusion 42*a*, allowing the roller shaft 34 to rotate by the driving force of the roller spring 43. As the roller shaft 34 rotates, the feed roller 47 starts rotating and becomes engaged with the drive gear 46. The pickup roller 31 then rotates at one revolution or at a predetermined angle, until the toothless portion returns to its initial position facing the drive gear 46.

Figure 12A:
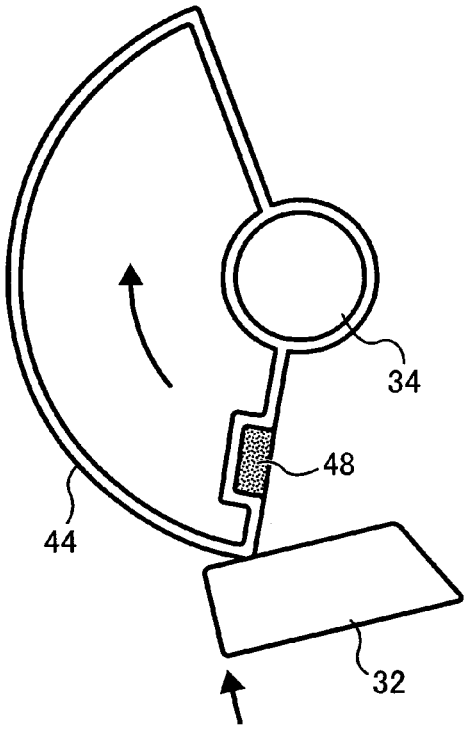
FIG. 12A is a cross-sectional view illustrating a portion of the sheet feeding device of FIG. 4 having a cam and the base plate, when the base plate is kept away from the pickup roller.
Figure 12B:
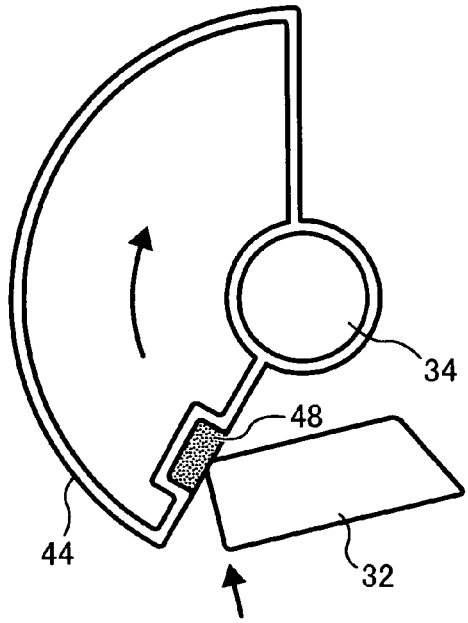
FIG. 12B is a cross-sectional view illustrating a portion of the sheet feeding device of FIG. 4 having the cam and the base plate, when the base plate is moved toward the pickup roller.

In this example, the base plate 32 moves toward or away from the pickup roller 31 in synchronization with the rotation of the pickup roller 31. As shown in FIGS. 4, 5 and 11, a cam 44 is integrally formed with the roller shaft 34. Referring to FIG. 12A, the cam 44 is initially positioned so as to closely contact and press the base plate 32. As the cam 44 rotates in the clockwise direction together with the roller shaft 34, the base plate 32 is moved upward in the direction toward the pickup roller 31 as illustrated in FIG. 12B.

In this example, an elastic body may be provided at a portion covering the point at which the base plate 32 contacts the cam 44 to suppress any damage, which may be caused on the base plate 32 when the base plate 32 contacts the cam 44. For example, as illustrated in FIGS. 12A and 12B, an elastic section 48 may be provided on the cam 44. Alternatively, the elastic section 48 may be provided on the base plate 32. The elastic section 48 may be made of an elastic material such as rubber, for example.

Referring back to FIGS. 9A and 9B, an operation of feeding a recording sheet P during an image forming operation is explained according to an exemplary embodiment of the present invention. In this example, the manual feed tray 8 is assumed to have mounted thereon the maximum number of recording sheets P when the image forming operation has started.

Referring to FIG. 9A, when the actuation signal is received, the pickup roller 31 starts rotating in the clockwise direction. The base plate 32 moves toward the pickup roller 31 in synchronization with the rotation of the pickup roller 31. Since the height of the stack Pmax is high, the leading top edge of the stack Pmax soon contacts the first circumferential section 31*a* at the first contact point B. The pickup roller 31 continues to rotate, however, the first circumferential section 31*a* has relatively a low friction coefficient such that transfer of the recording sheet P place at the top of the stack Pmax is suppressed. When the leading edge of the top recording sheet P contacts the second circumferential section 31*b* having relatively a high friction coefficient, the top recording sheet P is transferred toward the friction pad 33 with the rotation of the pickup roller 31. After rotating at the predetermined angle, the pickup roller 31 is returned to the initial position. Accordingly, the base plate 32 is returned to the initial position.

By repeating the above-described operation, the number of recording sheets P mounted on the manual feed tray 8 will be finally reduced to the minimum number, such as one, as illustrated in FIG. 9B. Since the height of the stack Pmin is low, it takes longer for the base plate 32 to bring the recording sheet P in contact with the pickup roller 31 as compared with the example case described referring to FIG. 9A. Accordingly, the leading top edge of the stack Pmin contacts the first circumferential section 31*a* at the second contact point D. The recording sheet P is prevented from being transferred due to the low friction coefficient of the first circumferential section 31*a*. As soon as the leading edge of the recording sheet P contacts the second circumferential section 31*b*, the recording sheet P is transferred toward the friction pad 33 with the rotation of the pickup roller 31. After rotating at a predetermined angle, the pickup roller 31 is returned to the initial position. At the same time, the base plate 32 is returned to the initial position.

In this example, the actuation signal may be generated by a sheet detector for detecting a trailing edge of the recording sheet P placed at the top of the stack ("the trailing top edge of the stack"). The sheet detector may be provided near the pickup roller 31. As soon as the sheet detector detects the trailing edge of the recording sheet P, the actuation signal is generated to start another sheet feeding operation.

Figure 13:
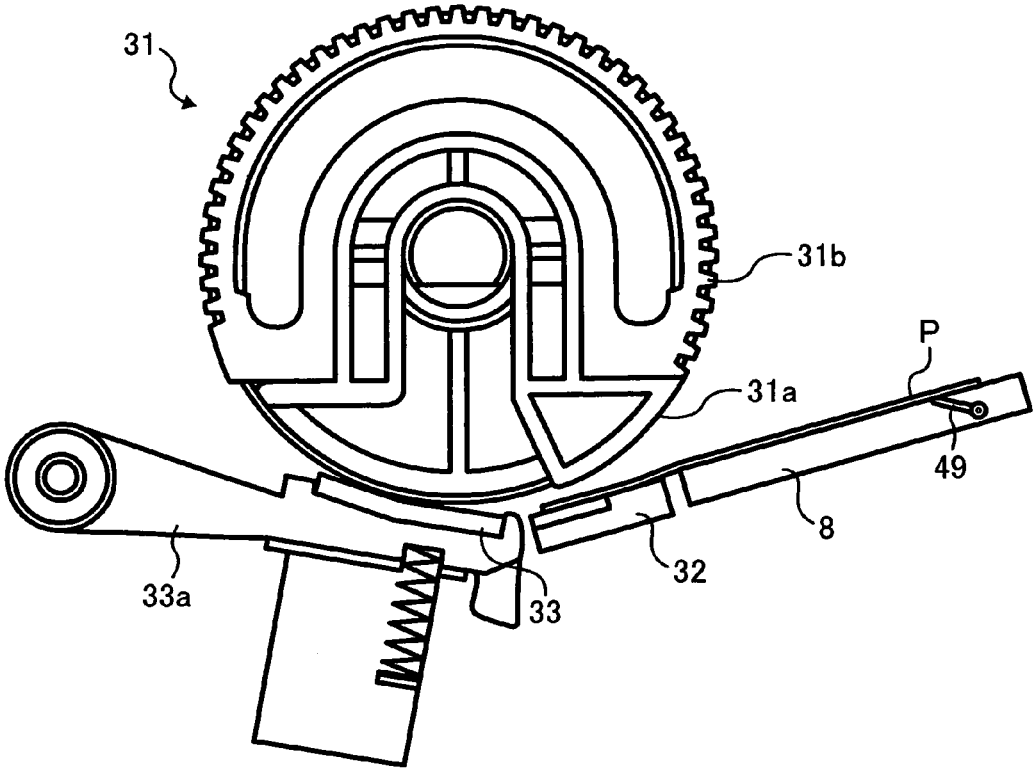
FIG. 13 is a schematic cross-sectional view illustrating a portion of a sheet feeding device having a sheet detector according to an exemplary embodiment of the present invention.

As illustrated in FIG. 13, a sensor 49, which serves as the sheet detector, may be preferably provided on the manual feed tray 8. The position of the sensor 49 may be determined by a minimum size of the recording sheet P, such as its trailing edge. By providing the sensor 49 at the position corresponding to the trailing edge of the recording sheet P, the speed of the sheet feeding operation may be increased.

Numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

This patent specification is based on and claims priority to Japanese patent application No. 2004-313382 filed on Oct. 28, 2004, in the Japanese Patent Office, the entire contents of which are hereby incorporated by reference.

The invention claimed is:

1. A sheet feeding device, comprising:

a sheet feeding apparatus including a sheet feeding roller including a first circumferential section of said sheet feeding roller having a first friction coefficient and a second circumferential section of said sheet feeding roller having a second friction coefficient configured to rotate in a direction from the first circumferential section to the second circumferential section;

a pressure plate provided apart from the sheet feeding roller and configured to mount thereon a recording sheet stack positioned below said sheet feeding roller, said sheet stack having recording sheets ranging from a maximum number to a minimum number;

a cam integrally formed with the sheet feeding roller to cause the pressure plate to move upward, the cam and the first circumferential section being provided to cause a recording sheet to contact the first circumferential section when the maximum number of recording sheets are mounted on the pressure plate and when the minimum number of recording sheets are mounted on the pressure plate; and a support body configured to fix the pressure plate by a first guide shaft and a second guide shaft, wherein the pressure plate comprises:

a first plate opening having a first length, configured to receive the first guide shaft; and a second plate opening, having a second length, configured to receive the second guide shaft, the first length being larger than the second length, the first plate opening and second plate opening facing the sheet feeding roller, and the pressure plate is configured to move along the guide shafts in a direction toward or away from the sheet feeding roller, wherein the first circumferential section comprises:

a first contact point of said sheet feeding roller for contacting, when the sheet feeding roller is rotated, a leading top edge of the recording sheet stack having the maximum number of recording sheets; and a second contact point of said sheet feeding roller for contacting, when the sheet feeding roller is rotated, a leading top edge of the recording sheet stack having the minimum number of recording sheets and for feeding the recording sheets by contact with said sheet feeding roller below which said recording sheet stack is positioned, wherein a radius of the first circumferential section at the second contact point is equal to a radius of a trailing edge point of the first circumferential section.

2. The device of claim 1, wherein the first friction coefficient is substantially lower than that of the recording sheets.

3. The device of claim 2, wherein the second friction coefficient is substantially higher than that of the recording sheets.

4. The device of claim 1, wherein the first friction coefficient is lower than the second friction coefficient.

5. The device of claim 1, wherein the sheet feeding roller has a semilunar cross section.

6. The device of claim 1, further comprising:

a sheet separator provided in proximity with the first circumferential section and configured to separate the recording sheets one by one.

7. The device of claim 6, wherein the sheet feeding roller further comprises a cut section facing the sheet separator.

8. The device of claim 1, wherein the first circumferential section further comprises:

a leading edge point at which the first circumferential section starts; and the trailing edge point at which the first circumferential section ends.

9. The device of claim 8, wherein the length between the leading edge point and the trailing edge point is larger than the length between the first contact point and the second contact point.

10. The device of claim 1, wherein the pressure plate moves toward the sheet feeding roller in synchronization with the rotation of the sheet feeding roller.

11. The device of claim 10, wherein the cam is configured to contact the pressure plate at a third contact point when the pressure plate moves toward the sheet feeding roller, said cam having a shape on one side which includes a curved portion and two straight portions, said third contact point being located on a portion of one of the straight portions, and said pressure plate being configured to contact the third contact point with a corner edge of the pressure plate as the pressure plate moves toward the sheet feeding roller.

12. The device of claim 11, wherein the cam comprises an elastic body covering the third contact point.

13. The device of claim 11, wherein the pressure plate comprises an elastic body covering the third contact point.

14. The device of claim 1, further comprising:

a sheet detector configured to generate a detection result indicating whether a trailing top edge of the recording sheet stack is detected and to cause the sheet feeding roller to rotate based on the detection result.

15. The device of claim 14, wherein the sheet detector is provided near the pressure plate at a portion determined by a minimum sheet size of the recording sheet.

16. An image forming apparatus comprising:

a scanner section configured to read an original image into image data;

an image forming section configured to form an image on a recording sheet according to the image data; and a sheet feeding section configured to transfer the recording sheet, wherein the sheet feeding section comprises:

a sheet feeding roller having a first circumferential section of said sheet feeding roller including a first friction coefficient and a second circumferential section of said sheet feeding roller having a second friction coefficient configured to rotate in a direction from the first circumferential section to the second circumferential section;

a pressure plate provided apart from the sheet feeding roller and configured to mount thereon a recording sheet stack positioned below said sheet feeding roller, said sheet stack having recording sheets ranging from a maximum number to a minimum number;

a cam integrally formed with the sheet feeding roller to cause the pressure plate to move upward, the cam and the first circumferential section being provided to cause a recording sheet to contact the first circumferential section when the maximum number of recording sheets are mounted on the pressure plate and when the minimum number of recording sheets are mounted on the pressure plate; and a support body configured to fix the pressure plate by a first guide shaft and a second guide shaft, wherein the pressure plate comprises:

a first plate opening having a first length, configured to receive the first guide shaft and a second plate opening, having a second length, configured to receive the second guide shaft, the first length being larger than the second length, the first plate opening and second plate opening facing the sheet feeding roller, and the pressure plate is configured to move along the guide shafts in a direction toward or away from the sheet feeding roller, the first circumferential section comprising:

a first contact point of said sheet feeding roller for contacting, when the sheet feeding roller is rotated, a leading top edge of the recording sheet stack having the maximum number of recording sheets; and a second contact point of said sheet feeding roller for contacting, when the sheet feeding roller is rotated, a leading top edge of the recording sheet stack having the minimum number of recording sheets and for feeding the recording sheets by contact with said sheet feeding roller below which said recording sheet stack is positioned, wherein a radius of the first circumferential section at the second contact point is equal to a radius of a trailing edge point of the first circumferential section.

17. A sheet feeding device as claimed in claim 16, further comprising a drive mechanism configured to drive said sheet feeding roller during contact of said first circumferential section with the recording sheets at said first and second contact point.

18. A sheet feeding device as claimed in claim 16, wherein said sheet feeding roller comprises a one piece feeding roller.

19. An image forming apparatus as claimed in claim 16, further comprising a drive mechanism configured to drive said sheet feeding roller during contact of said first circumferential section with the recording sheets at said first and second contact point.

20. An image forming apparatus as claimed in claim 16, wherein said sheet feeding roller comprises a one piece feeding roller.

21. A device for transferring a recording medium, comprising:

means for mounting a recording medium stack having recording media ranging from a maximum number to a minimum number;

means for feeding the recording media one by one from the mounting means, said means for feeding having a first circumferential section;

a cam integrally formed with the means for feeding to cause the means for mounting to move upward, the cam and the first circumferential section being provided to cause a recording sheet to contact the first circumferential section when the maximum number of recording sheets are mounted on the means for mounting and when the minimum number of recording sheets are mounted on the means for mounting; and a supporting means for fixing the means for mounting by a first guide shaft and a second guide shaft, wherein the means for mounting comprises:

a first plate opening having a first length, configured to receive the first guide shaft; and a second plate opening, having a second length, configured to receive the second guide shaft, the first length being larger than the second length, the first plate opening and second plate opening facing the means for feeding, and the mounting means is configured to move along the guide shafts in a direction toward or away from the means for feeding, wherein the feeding means comprises:

a first contact point on the first circumferential section of said feeding means for contacting, when the feeding means is driven, a leading top edge of the recording medium stack having the maximum number of recording media; and a second contact point on the first circumferential section of said feeding means for contacting, when the feeding means is driven, a leading top edge of the recording medium stack having the minimum number of recording media, and for feeding the recording sheets by contact with said means for feeding the recording media wherein said means for feeding the recording media comprises a sheet feeding roller;

wherein a radius of the first circumferential section at the second contact point is equal to a radius of a trailing edge point of the first circumferential section and wherein said recording medium stack is positioned below said means for feeding the recording media.

22. A device for transferring a recording medium as claimed in claim 21, further comprising drive means for driving said sheet feeding roller during contact of said first circumferential section with the recording media at said first and second contact point.

23. A device for transferring a recording medium as claimed in claim 21, wherein said means for feeding the recording media comprises a one piece feeding roller.

* * * * *